US006155539A

United States Patent [19]

Nakayama

[11] Patent Number: 6,155,539

[45] Date of Patent: Dec. 5, 2000

[54] FURRING STRIPS FOR FENCE AND FENCE

[75] Inventor: Kiyoshi Nakayama, Kagawa, Japan

[73] Assignee: Asahi Steel Industry Co., Ltd., Kagawa, Japan

[21] Appl. No.: 09/091,969

[22] PCT Filed: Nov. 6, 1996

[86] PCT No.: PCT/JP96/03245

§ 371 Date: Jun. 26, 1998

§ 102(e) Date: Jun. 26, 1998

[87] PCT Pub. No.: WO97/26431

PCT Pub. Date: Jul. 24, 1997

[30] Foreign Application Priority Data

Jan. 16, 1996 [JP] Japan ..... 8-21595

[51] Int. Cl.[7] ..... E04H 17/16

[52] U.S. Cl. ..... 256/21; 256/32; 256/25; 52/694

[58] Field of Search ..... 256/21, 73, 32, 256/33, 24, 25, 26; 52/694, 695

[56] References Cited

U.S. PATENT DOCUMENTS

| | | | |
|---|---|---|---|
| 1,074,693 | 10/1913 | Carter et al. . | |
| 2,004,907 | 6/1935 | Wallen et al. . | |
| 3,101,929 | 8/1963 | Dvore . | |
| 3,402,522 | 9/1968 | Guddal . | |
| 4,054,013 | 10/1977 | Pitto et al. | 52/641 X |
| 4,124,196 | 11/1978 | Hipskind | 256/1 X |
| 4,442,650 | 4/1984 | Sivachenko | 52/694 |
| 5,448,866 | 9/1995 | Saito et al. | 52/414 X |
| 6,000,682 | 12/1999 | Lechtenbohmer | 256/32 |

FOREIGN PATENT DOCUMENTS

| | | | |
|---|---|---|---|
| 576799 | 1/1994 | European Pat. Off. | 256/33 |
| 626490 | 11/1994 | European Pat. Off. | 256/33 |
| 2427705 | 12/1975 | Germany | 256/351 X |
| 3309542 | 12/1983 | Germany | 256/73 |
| 5-248124 | 9/1993 | Japan | 256/33 |
| 6-42232 | 2/1994 | Japan | 256/33 |
| 6-42233 | 2/1994 | Japan | 256/33 |
| 6-42234 | 2/1994 | Japan | 256/33 |
| 6-42235 | 2/1994 | Japan | 256/33 |
| 7-81426 | 8/1995 | Japan . | |
| 3075 | 11/1870 | United Kingdom | 256/21 |

*Primary Examiner*—Lynne H. Browne
*Assistant Examiner*—John R. Cottingham
*Attorney, Agent, or Firm*—Nields & Lemack

[57] ABSTRACT

A fence and a furring strip for fence, which are light in weight and strong and are resistant to snow and wind are provided. Bent wire rods 1 are bent in a triangle shape, at the top 10 of which, at the portion a little off-center, a pair of parallel wire rods 2 are mounted both on the front and the rear sides. The furring strip in such a construction is inserted between vertical wire rods 51, 51 of the fence body formed like a folding screen. The furring strip is fixed on the fence body by an appropriate fitting and forms a fence.

4 Claims, 8 Drawing Sheets

FURRING STRIPS FOR FENCE AND FENCE

TECHNICAL FIELD

The invention relates to a furring strip for fence and a fence.

BACKGROUND ART

A fence is provided with furring strips for supporting and strengthening a fence body, by which a fence is usually strengthened and joined to a support.

A conventional furring strip is made of a pipe or the like, which is heavy in weight and presents heavy external appearance while it is strong. The furring strip is subject to wind pressure and snow weight, which causes in a strong wind area or a snowfall area disadvantage in strength. Further the furring strip cannot be easily cut on the spot the fence is built.

An object of the invention is to improve said disadvantage of the conventional art and to provide a furring strip which is light in weight, looks light, has little resistance to wind and is not subject to snow weight.

Another object is to provide a fence, which is light in weight, strong and has good outside appearance.

DISCLOSURE OF INVENTION

In order to accomplish said objects, the furring strip of the invention is characterized in comprising a bent wire rod which is bent alternately in opposite directions at predetermined intervals and a pair of parallel wire rods extending in a longitudinal direction which is provided with said bent wire at the front and the back sides.

Thus the furring strip of the invention is light in weight and tends not to be affected by wind and snow. It looks light as well. Further, the bent wire rod creates strength in a lateral direction and the parallel wire rods provide strength in a thickness direction, that causes large strength of the fence while being light in weight. Moreover the construction at the scene is easy, because processing steps, such as cutting the wire rods is easy.

The top of the bent wire rod preferably projects from the parallel wire rod so as to make welding work easy.

Though the furring strip of the invention may be adapted to many types of fence, it is most appropriately applied to a wire lattice fence, more preferably, to a fence where lateral wire rods are bent so as to form a folding screen-like-shape. It is hoped to locate the furring strip so as to make the locations of both tops of the bent lateral wire rods and said bent wire rod coincident. Such construction provides a fence with a nice appearance and larger strength. It is easy to set a plurality of the fences in steps.

BEST MODE OF CARRYING OUT THE INVENTION

An embodiment of the invention will be explained hereafter referring to drawings.

Figure 1:
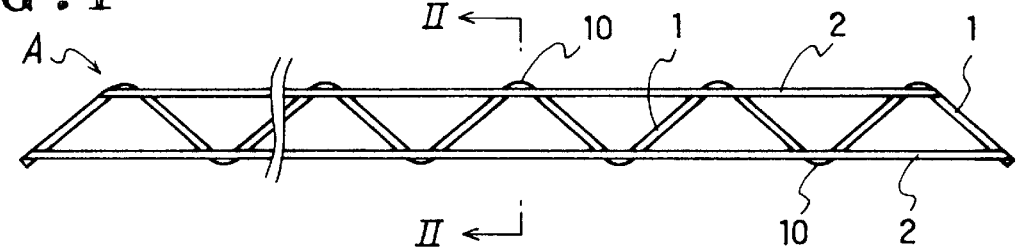
FIG. 1 is a plan view of an embodiment of the invention.

FIG. 1 is a plan view of a furring strip A of the invention, which comprises a bent wire rod 1, with a total of successively bent in a triangle form and a pair of parallel wire rods 2.

The parallel wire rods 2 are secured on both the front and back sides of the bent wire rod 1, with a total of four parallel wire rods 2 used there.

The parallel wire rods 2 are so set that a top 10 of the bent wire rod 1 projects a little over the outside of the pair of parallel wire rods 2.

Figure 2:
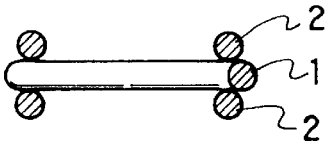
FIG. 2 is a II—II line sectional view of FIG. 1.

This construction is to make welding the bent wire rod 1 and the parallel wire rods 2 easy. As shown in FIG. 2, the positions of the parallel wire rods 2 become stable and it leads to easy welding.

Figure 3:
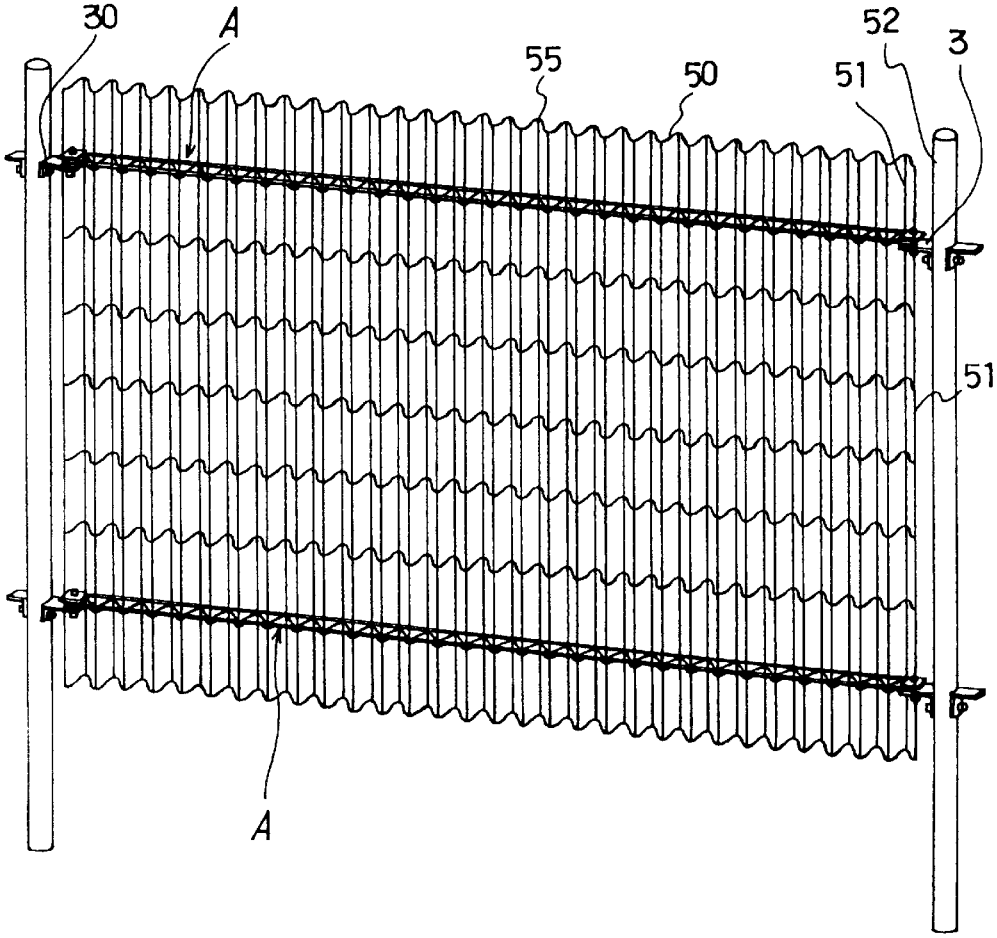
FIG. 3 is a perspective view of an embodiment of a fence of the invention.

FIG. 3 shows an application where the furring strip A is provided on a fence. The fence is a latticework fence consisting of horizontal wire rods 50 bent into a sine curve shape and vertical wire rods 51 mounted on horizontal wire rod tops 55 of the curves. The fence is shaped entirely like a folding screen. The furring strip A is inserted among the vertical wire rods 51 parallel to the horizontal wire rods 50 and is bundled with the horizontal wire rods 50 by an appropriate joint piece (not shown). The furring strips A are provided respectively with an upper end and a lower end of the fence. The number of the furring strip A may be increased or decreased depending on the height of the fence.

Figure 4:
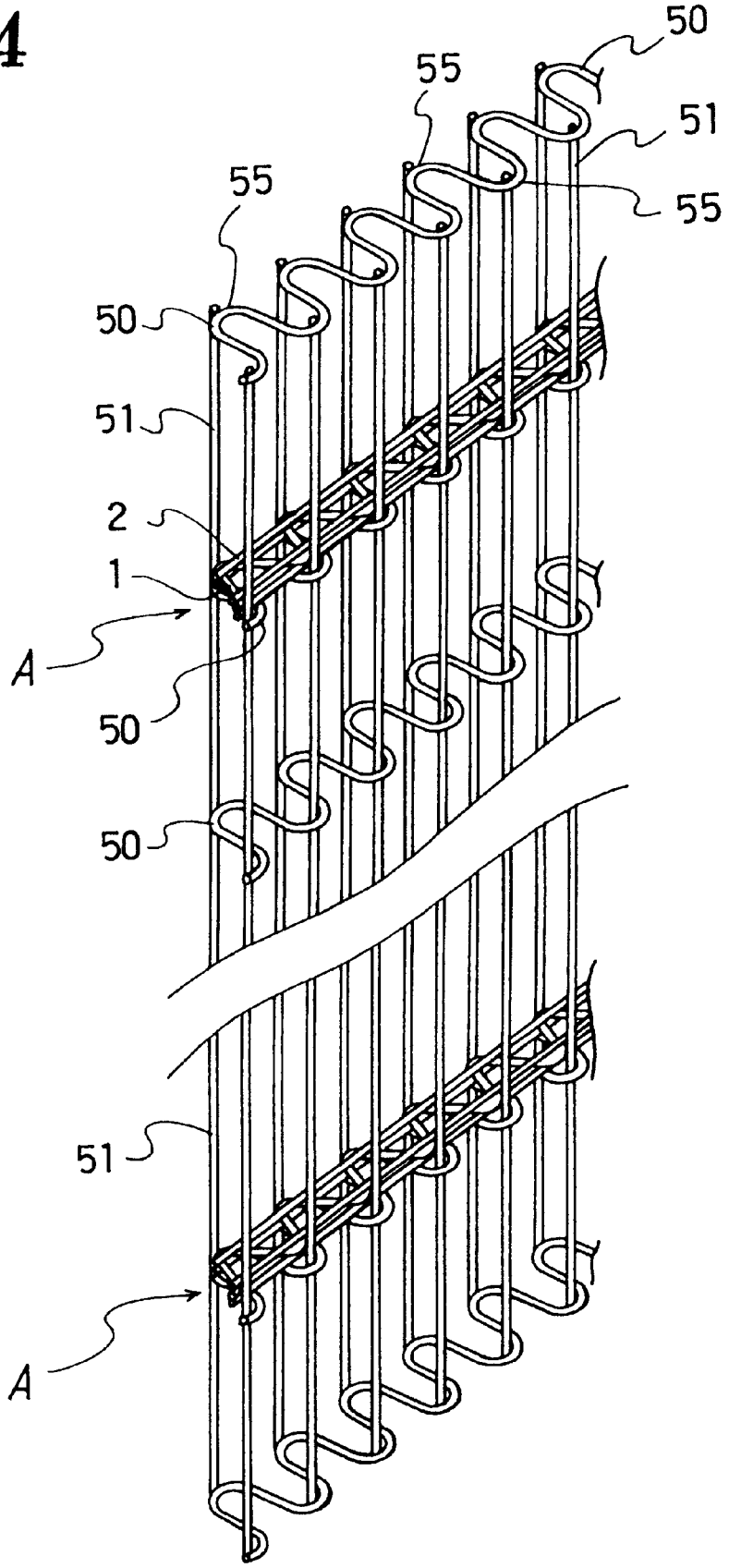
FIG. 4 is a partly enlarged view of FIG. 3.

FIG. 4 is a partially enlarged view of the embodiment of FIG. 3 where the furring strip A is mounted on the fence.

Figure 5:
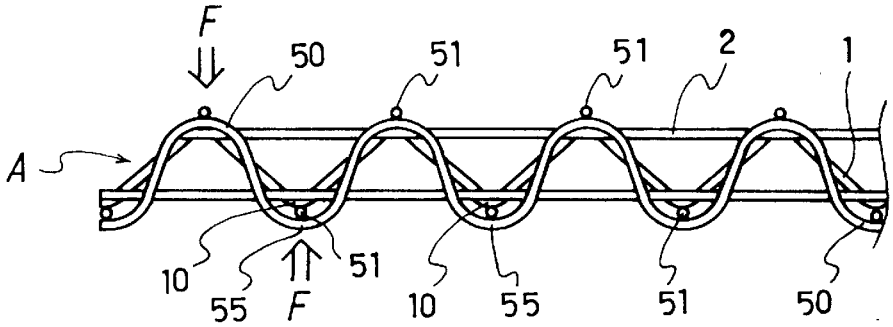
FIG. 5 is a plan view explaining a relation of pitches between a bent wire rod 1 and a horizontal wire rod 50.

FIG. 5 shows the coincidence of pitches between the horizontal wire rod 50 and the parallel wire rod 2. In the embodiment, the pitches are so arranged that the position of the horizontal wire rod top 55 agrees to the position of the top 10. The arrangement provides the fence with large strength against a force F from the front of the fence.

Figure 6:
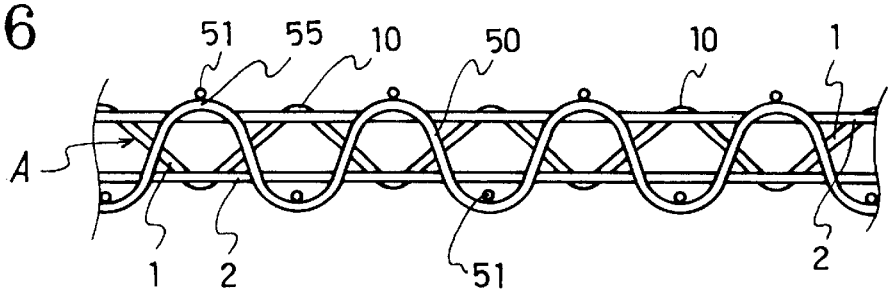
FIG. 6 is another plan view explaining a relation of pitches between the bent wire rod 1 and the horizontal wire rod 50.

FIG. 6 shows another embodiment where the position of the top 10 is off the position of the horizontal wire rod top 55. This arrangement has an advantage that strength against the force F from the front is averaged because the strong positions of tops 10 and horizontal wire rod top 55 are dispersed.

Further, there are some advantages. For example, the construction of such fence is easy because it is not needed to make the pitches agree and the production of the furring strip is easy because it is not necessary to coincide the pitch of the bent wire rod 1 with the pitch of the horizontal wire rod 50.

Figure 7:
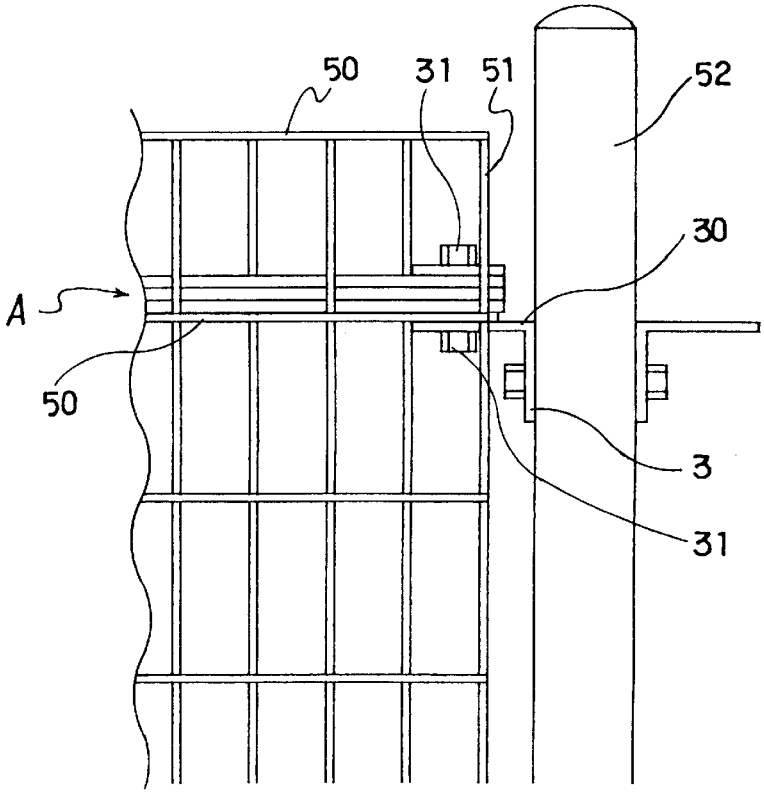
FIG. 7 is an enlarged view of a connecting fitting 43

FIG. 7 is an enlarged view of the furring strip A, a support 52 and a fitting 3. The fitting 3 includes an L shape fitting 30 and bolt & nut 31. The furring strip A is put on the horizontal wire rod 50 and the L shape fitting 30 is put on the below side of the horizontal wire rod 50 and the bolt & nut 31 bundles integrally the L shape fitting 30, the horizontal wire rod 50 and the furring strip A.

Another end of the L shape fitting 30 is fixed on the support 52 by a bolt or the like so that the furring strip A is connected to the support 52.

Figure 8:
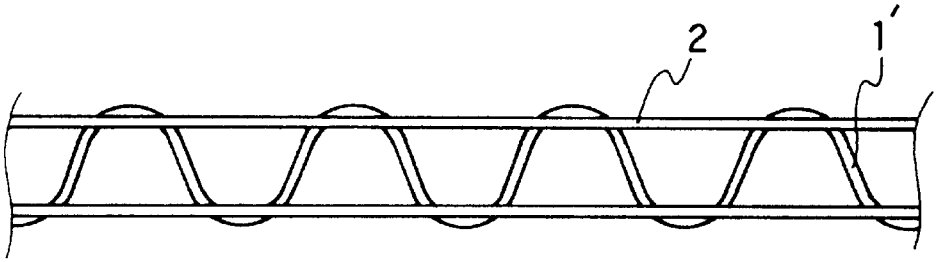
FIG. 8 is a plan view of anther embodiment of a furring strip of the invention.

Though the bent wire rod 1 is bent in a triangle shape in the above-mentioned embodiment , the invention is not limited to the triangle shape. Any shape may be adopted as far as it is bent successively in alternate directions. FIG. 8 shows another embodiment where a bent wire rod 1' is bent in a sine curve shape. Many other shapes, for example a successive rectangular shape or a successive trapezoidal shape may be adopted.

The furring strip A made of wire rods is lighter than the conventional furring strip made of a pipe or the like and it is hard to receive weight of snow and wind force. The bent wire rod 1 provides the strength in the lateral direction and four pieces of the parallel wire rod 2 provides the strength in thickness direction with the furring strip A. The external view of the furring strip A is lighter. The length of the furring strip A can be adjusted easily at the construction spot by cutting the wires composing the furring strip A. Further bending the furring strip A is easy.

It becomes possible to compose a whole fence of only wire rods by virtue of the combination of the furring strip A and the lattice fence shown in FIG. 3 made of wire rods and shaped in a folding screen like form. Such fence is resistant to wind and snow and provides excellent outside appearance giving a light feeling.

Figure 9:
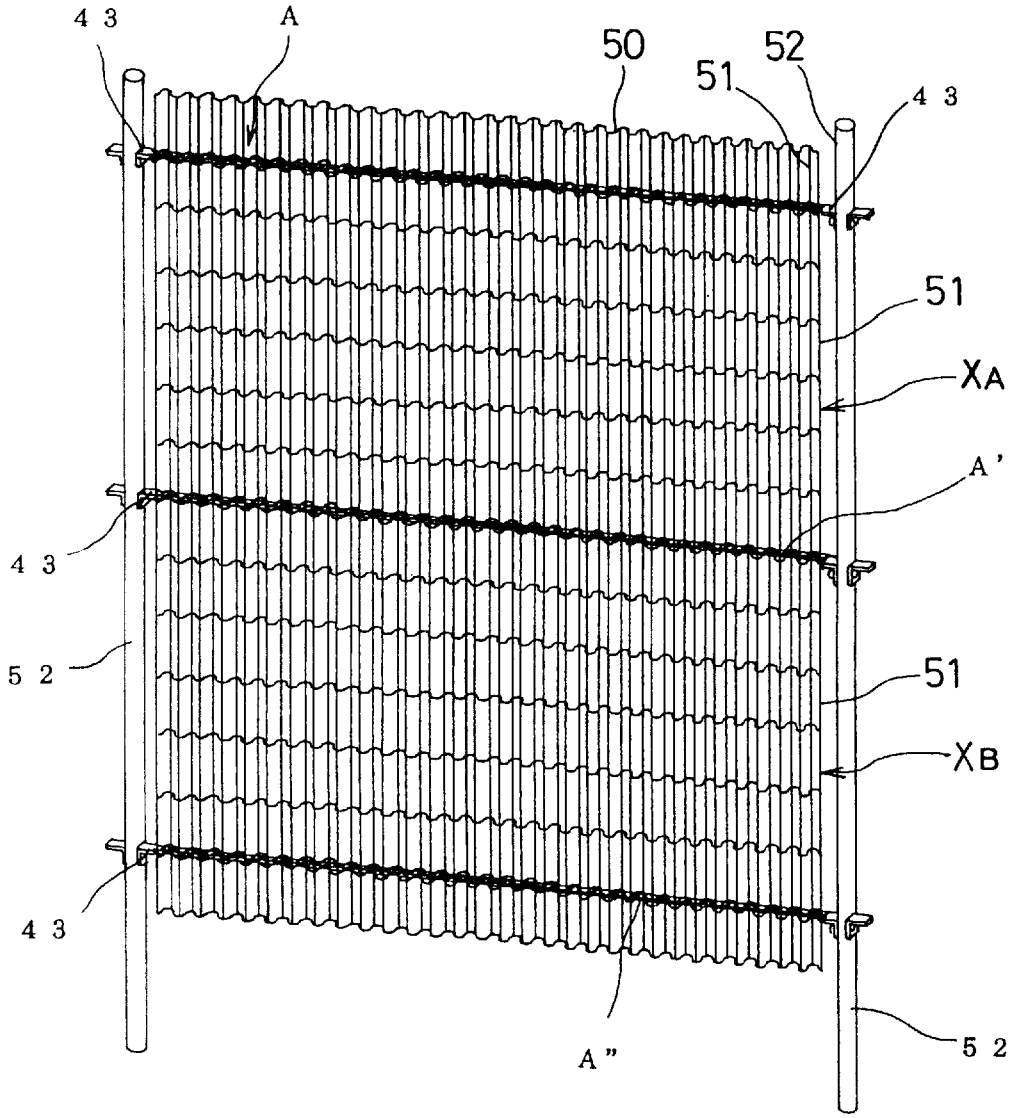
FIG. 9 is a perspective view showing an embodiment of the invention.
Figure 10:
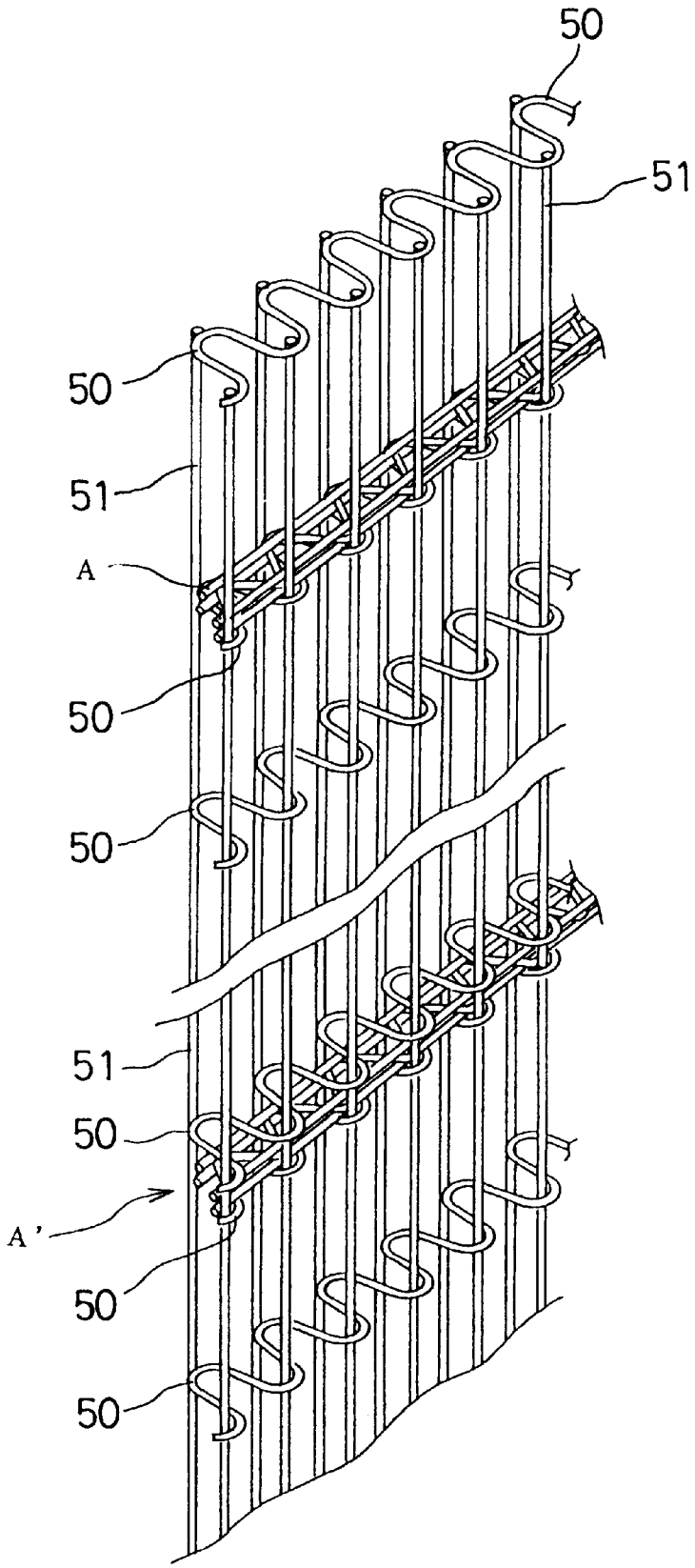
FIG. 10 is a partly enlarged perspective view showing an embodiment of the invention.

FIG. 9 shows a double piled fence having fences XA and XB arranged in a vertical direction. Though it is possible to put three or more fences on top of one another, only one embodiment having two fences will be explained to simplify the explanation. FIG. 10 is a partially enlarged perspective view.

The fences XA, XB also have the horizontal wire rods 50 bent alternately like a sine curve shape and the vertical wire rods 51 fixed the top of the horizontal wire rods 50 by welding and the like and they are shaped in a folding screen like form. The vertical wire rods 51 are arranged in a checked pattern at the plan view, through which the furring strip A is inserted. This is the same as the above-mentioned embodiment.

The upper fence XA is fixed on the support 52 by the furring strip A inserted in the upper portion of the fence XA and a furring strip A' for connection is put on the lower portion using a connecting fitting 43. The lower fence XB is connected at the upper portion to the support 52 by the connection furring strip A' using the connecting fitting 43 and at the lower portion it is connected to the support 52 by a furring strip A" using the connecting fitting 43. Said furring strips A' and A" are completely the same as the furring strip A in construction.

The fences XA and XB use commonly the connection furring strip A'. When new fence will be arranged below the lower fence XB, the low end of the fence XB will be also connected by the furring strip A" with the third fence and the support 52.

Figure 11:
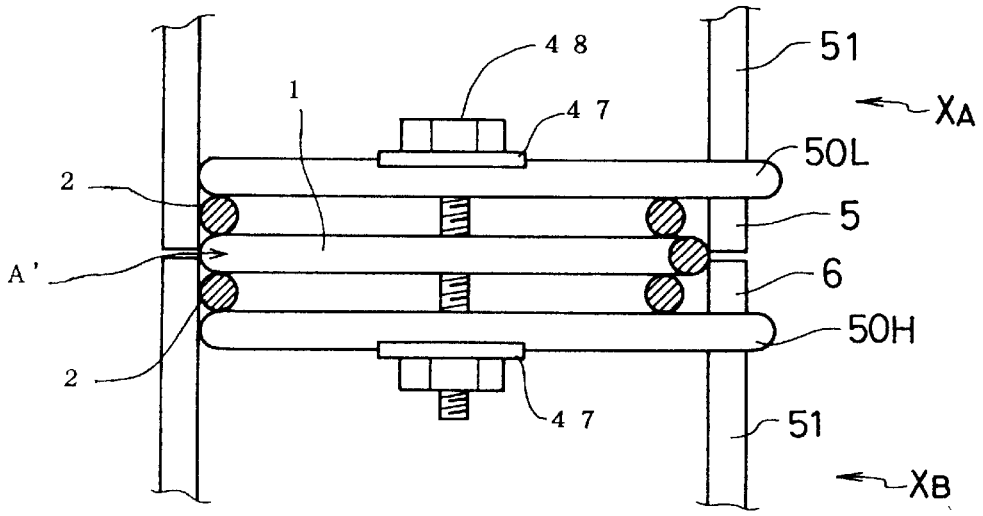
FIG. 11 is a side view showing a joint-structure of a furring strip A'.
Figure 12:
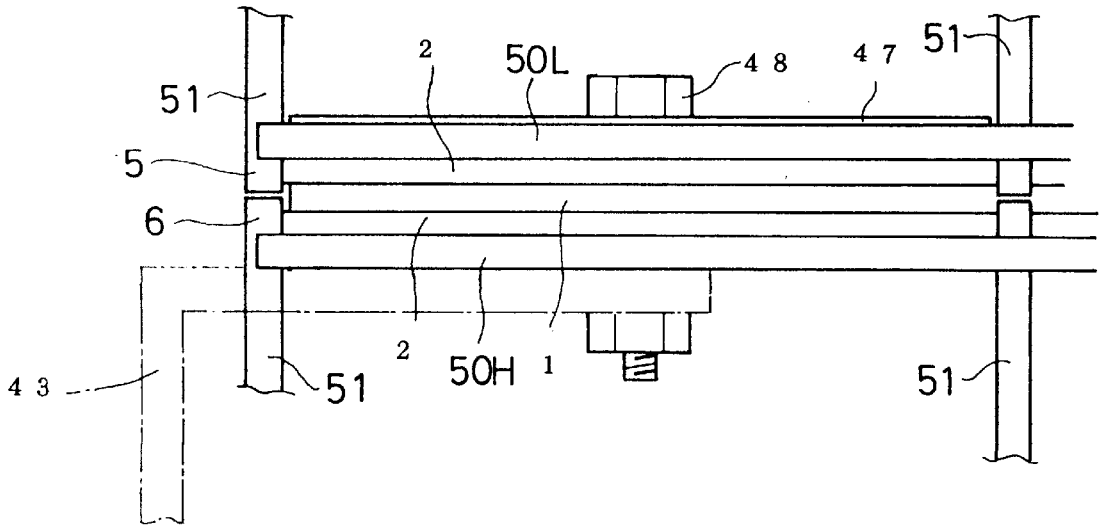
FIG. 12 is a front view showing the joint-structure of the furring strip A'.
Figure 13:
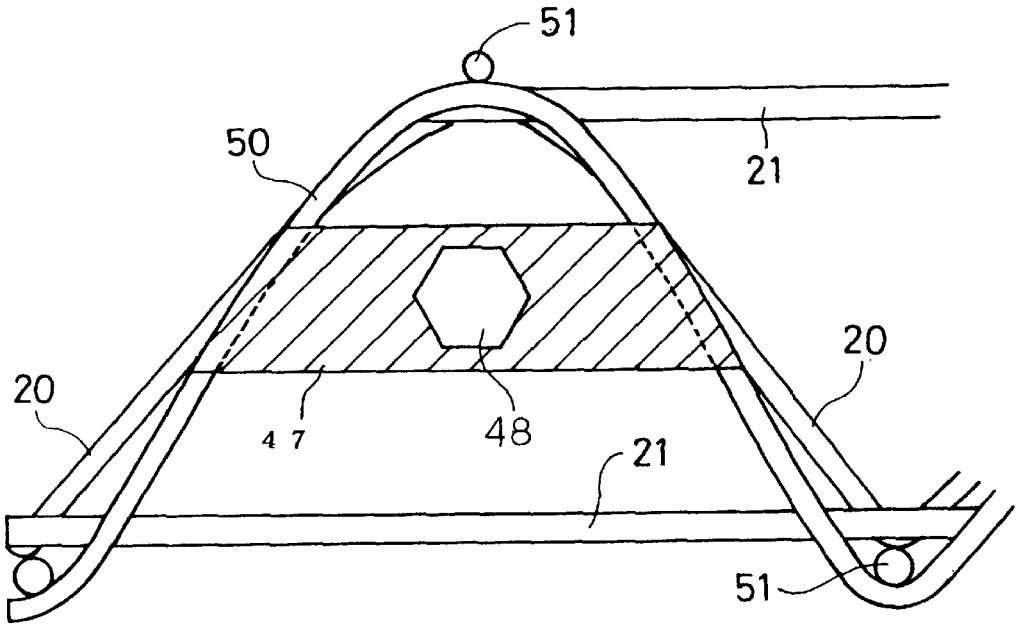
FIG. 13 is a plan view showing the joint-structure of the furring strip A'.

The construction of the furring strip A' is shown in from FIG. 11 to FIG. 13. FIG. 11 is a side view, FIG. 12 is a front view of the embodiment where the connecting fitting 43 is also fixed together with the fences at the top and bottom ends, and FIG. 13 is a plan view.

The fence XA includes the vertical wire rods 51 the bottom of which projects from the lowest horizontal wire rod 50L and form a projecting portion 5 at the lower end of the upper vertical wire rod, while the fence XB has the vertical wire rod 51 the top end of which projects from the highest horizontal wire rod 50H and forms a projecting portion 6 at the upper end of the lower vertical wire rod. The projecting portion 5 at the lower end of the upper vertical wire rod and projecting portion 6 at the upper end of the lower vertical wire rod are arranged opposite and the furring strip A' is inserted in a space between the horizontal wire rod 50L and the horizontal wire rod 50H. The connection furring strip A' is put between the horizontal wire rod 50L and the horizontal wire rod 50H and fastened together by a holding plate 47 and a bolt & nut 48. In this condition, there is a little space between the projecting portion 5 at the lower end of the upper vertical wire rod and the projecting portion 6 at the upper end of the lower vertical wire rod.

The holding plate 47 is in the shape corresponding to the shape of the horizontal wire rod 50 as shown in FIG. 13 and it binds both sides of the horizontal wire rod 50. The holding plates 47 are put on the horizontal wire rod 50H and the horizontal wire rod 50L and they are fastened together with the connection furring strip A' by a bolt & nut 48.

The fastening construction is adapted at several points in order to integrate the two fences XA and XB.

In FIG. 12, the connecting fitting 43 is provided only at both ends of the fence and fixed integrally below the horizontal wire rod 50H by the bolt & nut 48. In such case, the holding plate 47 at the lower side is not needed.

It is preferred that the fences XA and XB are in the same form and the shape, pitch and phase of the bent portion of the horizontal wire rod 50 of the fences are preferably the same.

The upper fence XA and the lower fence XB of the above-mentioned embodiment are connected by one piece of the furring strip A' and become an integrated fence.

Accordingly, there is no space between the upper and lower fences, which leads to the outside appearance like one fence and provides a good look. Further the number of parts can be reduced and also work for building up the fence can be saved.

As explained above, the invention may provides a fence and a furring strip for fence which are light, strong and resistant to snow and wind, and have excellent outside appearance. It is also possible to connect a plurality of fences by a few parts and work, therefore high fences may be built at low cost. The fences are connected integrally without space that provides good feeling in the external appearance.

What is claimed is:

1. A fence having a height and a length, comprising:

horizontal wire rods bent alternately along said length of the fence at certain intervals, vertical wire rods arranged parallel to each other so as to connect said horizontal wire rods, a furring strip inserted among said vertical wire rods and parallel to said horizontal wire rods, said furring strip having a bent wire rod bent having alternate bends at certain intervals, said bent wire rod having a front side and a backside; a first pair of parallel wire rods attached in a longitudinal direction to said front side of said bent wire rod, and a second pair of parallel wire rods attached in a longitudinal direction to said backside of said bent wire rod.

2. The fence of claim 1, wherein:

said bent wire rod has a plurality of first apexes formed by said alternate bends, said horizontal wire rods have a plurality of second apexes formed by said alternate bends, and wherein said furring strip is so located that said first apexes are parallel to said second apexes.

3. A wire lattice fence having a height and a length, horizontal wire rods bent alternately along said length of the fence at certain intervals, and vertical wire rods, comprising:

an upper wire lattice fence having upper vertical wire rods which project at a lower end, a lower wire lattice fence having lower vertical wire rods which project at an upper end and face said projecting upper vertical wire rods, a space between said projecting upper and lower vertical wire rods, a furring strip made of wire rods inserted in said space formed between said projecting upper and lower vertical wire rods, said furring strip and said upper and lower fences being combined integrally.

4. The fence of claim 3 wherein said furring strip comprises:

a bent wire rod having alternate bends at certain intervals, said bent wire rod having a front side and a backside, a first pair of parallel wire rods attached in a longitudinal direction to said front side of said bent wire rod, and a second pair of parallel wire rods attached in a longitudinal direction to said backside of said bent wire rod.

* * * * *